US006302660B1

(12) United States Patent
Kurita et al.

(10) Patent No.: US 6,302,660 B1
(45) Date of Patent: Oct. 16, 2001

(54) TUBE PUMP WITH FLEXIBLE TUBE DIAPHRAGM

(75) Inventors: Muneyasu Kurita; Fukuji Kuwabara, both of Iruma-gun (JP)

(73) Assignee: Iwaki Co., LTD (JP)

( * ) Notice: Subject to any disclaimer, the term of this patent is extended or adjusted under 35 U.S.C. 154(b) by 0 days.

(21) Appl. No.: 09/494,958

(22) Filed: Feb. 1, 2000

(30) Foreign Application Priority Data

Oct. 28, 1999 (JP) ..... 11-307633

(51) Int. Cl.[7] ..... F04B 35/02
(52) U.S. Cl. ..... 417/383; 417/394; 417/478
(58) Field of Search ..... 417/383, 385, 417/478, 388, 394, 900

(56) References Cited

U.S. PATENT DOCUMENTS

| | | | | |
|---|---|---|---|---|
| 2,345,693 | * | 4/1944 | Wilson et al. | 417/383 |
| 3,551,076 | * | 12/1970 | Wilson | 417/385 |
| 3,902,826 | * | 9/1975 | Nagel et al. | 417/388 |
| 3,990,815 | * | 11/1976 | DeVial | 417/383 |
| 3,999,896 | * | 12/1976 | Sebastiani | 417/383 |
| 4,439,112 | * | 3/1984 | Kitsnik | 417/383 |
| 4,474,540 | * | 10/1984 | Bonastia et al. | 417/388 |
| 4,934,906 | * | 6/1990 | Williams | 417/388 |
| 5,645,407 | * | 7/1997 | Kralick et al. | 417/383 |

FOREIGN PATENT DOCUMENTS

| | | | |
|---|---|---|---|
| 08226384 | 9/1996 | (JP) | 417/383 |
| 09151855 | 6/1997 | (JP) | 417/383 |

* cited by examiner

*Primary Examiner*—Cheryl J. Tyler
(74) *Attorney, Agent, or Firm*—Trexler, Bushnell, Giangiorgi, Blackstone & Marr, Ltd.

(57) ABSTRACT

As tube-phragm pump includes a pump head (1) and an electromagnetic driver (2). The pump head (1) includes a cylinder (21) having a cylindrical space formed therein, and a cylindrical flexible tube (22) arranged coaxially within the cylindrical space of the cylinder (21). The outer space between the tube and the cylinder defines an actuator fluid space to be filled with an actuator fluid, and the inner space within the tube defines a pump chamber for conveying an object fluid. The pump head also includes an intake valve (31) attached to one end portion of the flexible tube (22) and a discharge valve (42) arranged at the other end portion of the flexible tube (22). The electromagnetic driver (2) includes a plunger (71) arranged reciprocally movable in the axial direction, an electromagnet for periodically attracting the plunger (71) to drive it in the axial direction reciprocally, and diaphragm (52).

7 Claims, 5 Drawing Sheets

TUBE PUMP WITH FLEXIBLE TUBE DIAPHRAGM

BACKGROUND OF THE INVENTION

1. Field of the Invention

The present invention relates to a tube pump that employs a flexible tube diaphragm and is suitable for conveying slurry solution and the like.

2. Description of the Related Art

A tube pump with a flexible tube has been known as a pump suitable for conveying liquid. Such the tube pump has a structure, which defines outside and inside of a flexible tube diaphragm as an actuator fluid space and a pump chamber respectively, and which arranges an intake valve at one end portion of the flexible tube diaphragm and an discharge valve at the other end portion thereof. When an actuator fluid is periodically supplied into the actuator fluid space to expand and contract the flexible tube in the radial direction, an object fluid (a fluid to be conveyed) is conveyed by a repetition of suck and discharge of the object fluid into and from the pump chamber. The tube pump conveys a fluid by expanding and contracting the whole sidewall of the flexible tube in the radial direction. Therefore, it can obtain a larger liquid-conveying ability with a smaller size than a conventional diaphragm pump. In addition, unlike the conventional diaphragm pump, as the pump chamber in the tube pump is cylindrical, the object fluid can be conveyed straight. As a result, the tube pump has no part for causing the object solution to stay, thereby being suitable for conveying a slurry solution.

A conventional driving system has, however, a limitation which limits the liquid-conveying ability of the tube pump. In the conventional tube pump, a crankshaft is driven by a motor so as to move reciprocally a piston that is connected to the crankshaft. This motion allows oil to be introduced into and drawn from an oil hydraulic chamber. The introduction and draw of the oil deforms the diaphragm, which in turn deforms the flexible tube through a pressure transmission medium interposed between the diaphragm and the flexible tube. Therefore, a stroke and speed of motion of the piston would limit the liquid-conveying ability of the tube pump.

SUMMARY OF THE INVENTION

An object of the present invention is to provide a tube pump that is smaller and more excellent in a liquid-conveying ability than those in the art.

The present invention is provided with a tube pump, which comprises a pump head and an electromagnetic driver for driving the pump head. The pump head includes a cylinder having a columnar space formed therein and a cylindrical flexible tube arranged coaxially within the columnar space of the cylinder. The outer space between the tube and the cylinder defining an actuator fluid space to be filled with an actuator fluid, and the inner space within the tube defining a pump chamber for conveying an object fluid. The pump head also includes an intake valve attached to one end portion of the flexible tube and a discharge valve attached to the other end portion of the flexible tube. The electromagnetic driver includes a plunger arranged reciprocally movable in the axial direction, an electromagnet for periodically attracting the plunger to drive it in the axial direction reciprocally, and a diaphragm. The diaphragm is mounted on the top portion of the plunger and faces on the actuator fluid space for absorbing and discharging the actuator fluid into and from the actuator fluid space in response to the plunger reciprocally moving.

According to the present invention, the plunger is connected to the diaphragm that faces on the actuator fluid space outside the flexible tube, and the plunger is reciprocally driven by the electromagnet. Accordingly, a drive speed can be greatly increased compared to the oil hydraulic method using the crankshaft and piston. As a result, it is possible to increase a flow speed of the object fluid that passes through the flexible "tube-phragm", and to improve an effect of preventing the slurry from staying.

According to a preferred embodiment of the present invention, the cylinder and the flexible tube may be coupled with each other to compose a cylinder unit. The pump head includes a pump head body. The body has a cylindrical space to accommodate the cylinder unit therein, and an actuator fluid chamber connected to the cylindrical space on which one surface of the diaphragm of the electromagnetic driver faces. The cylinder unit is removably mounted onto the pump head body in a liquid-tight state.

According to the above configuration, the cylinder unit can be freely removed from the pump head body. Therefore, maintenance and inspection for the flexible tube and replacement of a damaged flexible tube can be easily performed.

In addition, if at least one of the intake and discharge valves are arranged within the inner spaces in the proximity of both end portions of the flexible tube, a total capacity of the pump chamber can be reduced. Accordingly, the pump chamber capacity against the discharge capacity can be reduced and a compressibility of a pump can be increased. Further, since the intake and discharge valves are arranged within the inner spaces in the proximity of both end portions of the flexible "tube-phragm", they hardly effect on deformation of the flexible tube.

Other features and advantages of the invention will be apparent from the following description of the preferred embodiments thereof.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

Figure 1:
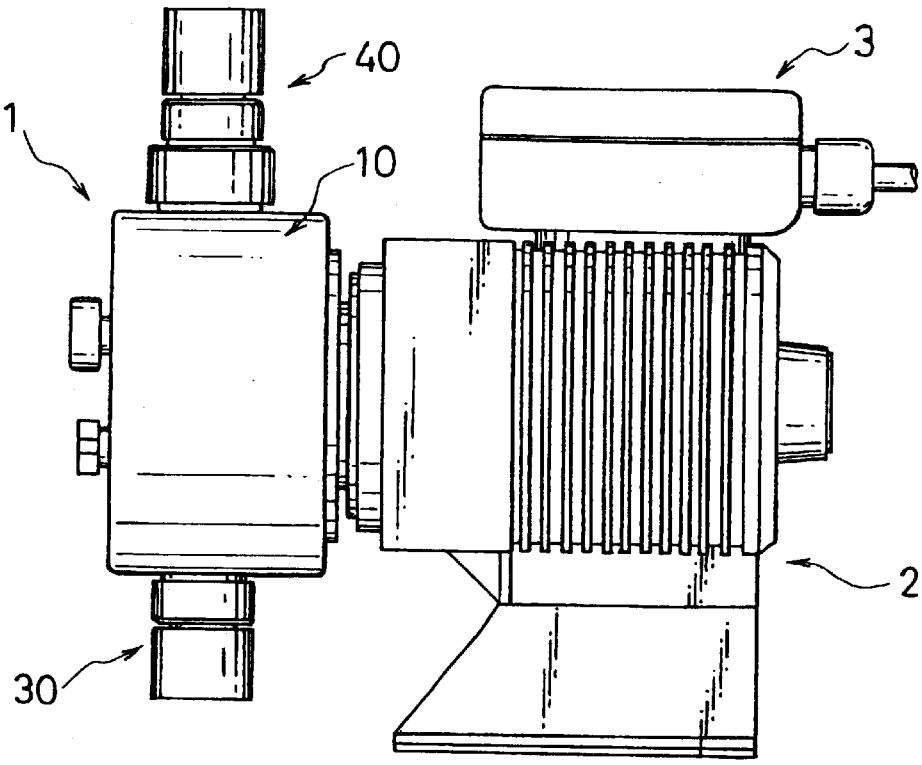
FIG. 1 is an external side view of a tube pump according to a first embodiment of the present invention.

As shown in FIG. 1, the tube pump of this embodiment comprises a pump head 1 containing a flexible tube therein, an electromagnetic driver 2 for driving the head, and a control unit 3 for controlling the driver 2.

Figure 2:
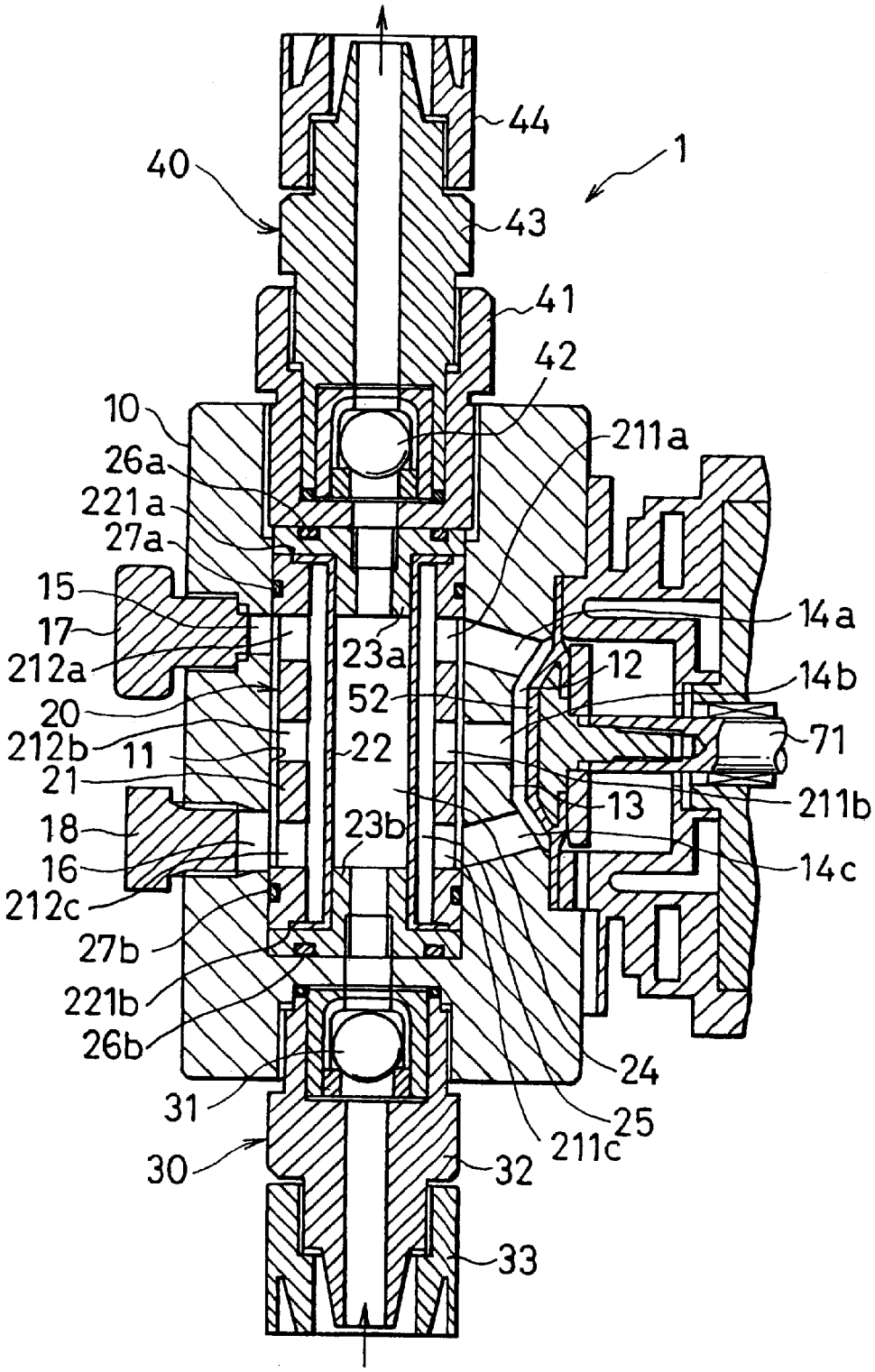
FIG. 2 is a cross sectional view of a pump head of the pump.

FIG. 2 shows a detailed cross sectional view of the pump head 1. The pump head 1 comprises a pump head body 10, a cylinder unit 20, an intake valve unit 30 and an discharge valve unit 40. The pump head body 10 has a cylindrical space 11 that is formed in the central section thereof and extends in the vertical direction. The cylinder unit 20 is cylindrical and is removably disposed within the cylindrical space 11 of the pump head body 10. The intake valve unit 30 is attached to the lower end portion of the pump head body 10 so that it can connect with the lower end portion of the cylinder unit 20. The discharge valve unit 40 is attached to the upper end portion of the pump head body 10 so that it can connect with the upper end portion of the cylinder unit 20.

A recess 13 is formed in a sidewall of the pump head body 10, close to the electromagnetic driver 2. It has a shape analogous to that of a diaphragm 52 in the electromagnetic driver 2 to be described later. The recess 13 forms an actuator fluid chamber 12 in conjunction with the diaphragm 52. In the sidewall that has the recess 13 formed, an array of three actuator fluid paths 14*a*, 14*b* and 14*c* is formed in the longitudinal direction to connect the cylindrical space 11 with the actuator fluid chamber 12. Formed in the opposite sidewall, of the pump head body 10, apart from the electromagnetic driver 2 are an actuator fluid inlet 15 and an air outlet 16, which are normally closed with plugs 17 and 18, respectively.

Figure 4A:
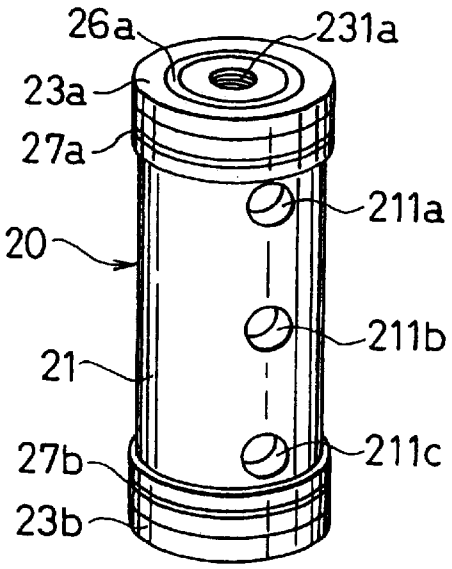
FIGS. 4A and 4B are general squint views of a cylinder unit of the pump.
Figure 4B:
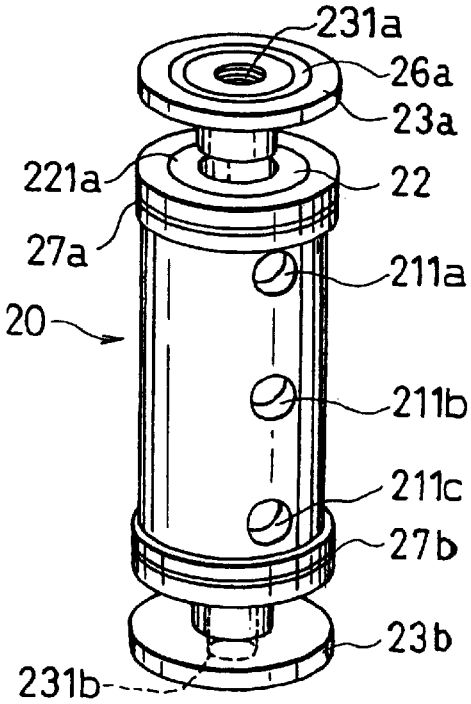

As shown in the cross sectional view of FIG. 2, the external squint view of FIG. 4A and the partially exploded squint view of FIG. 4B respectively, the cylinder unit 20 comprises a tubular cylinder 21, a cylindrical flexible tube 22 disposed coaxially within the cylinder 21, and tube retainers 23*a* and 23*b* for securing both end portions of the flexible tube 22 onto the cylinder 21. The flexible tube diaphragm 22 is formed to have the outer diameter smaller than the inner diameter of the cylinder 21 so as to define a pump chamber 24 inside and an actuator fluid chamber 25 outside. Formed at both end portions of the flexible tube diaphragm 22 are flanges 221*a* and 221*b*, which extend outwardly in the radial direction and engage in stages that are formed in both end portions of the cylinder 21. The tube retainers 23*a* and 23*b* have protruded top end portions that are inserted into inside of the tube 22, and disk-like basic portions that are employed to sandwich the flanges 221*a* and 221*b* of the tube 22 in conjunction with the stages at both end portions of the cylinder 21. O-rings 26*a* and 26*b* are attached on the outer edges of the disk-like basic portions, respectively. O-rings 27*a* and 27*b* are also attached on the rims in the proximity of both end portions of the cylinder 21, respectively. These O-rings allow the cylinder unit 20 to couple with the cylindrical space 11 of the pump head 10 and with the discharge valve unit 40 in a liquid-tight state.

The cylinder 21 is determined to have the outer diameter, except for both end portions, slightly smaller than the inner diameter of the cylindrical space 11 in the pump head body 10 so that a space for accommodating an actuator fluid can be formed between the inner surface of the cylindrical space 11 and the outer surface of the cylinder 21. Connection holes 211*a*, 211*b* and 211*c* are formed in the cylinder 21 at locations corresponding to the actuator fluid paths 14*a*–14*c* to connect between inside and outside of the cylinder 21. In addition, another connection holes 212*a*, 212*b* and 212*c* are formed in the cylinder 21 at locations corresponding in the radial direction to the connection holes 211*a*, 211*b* and 211*c*.

The intake valve unit 30 comprises an intake valve 31, a joint 32, and a nut 33. The intake valve 31 is provided at the lower end portion of the pump head body 10 so that it can be connected to the lower end portion of the pump chamber 24. The joint 32 supports the intake valve 31 and has a threaded portion to be attached to the lower end portion of the pump head body 10. The nut 33 is coupled to the lower end portion of the joint 32 and is employed for connecting a pipe. The discharge valve unit 40 comprises a joint 41, an discharge valve 42, another joint 43, and a nut 44. The joint 41 is employed to secure on the upper end portion of the pump head body 10. The discharge valve 42 is provided to connect with the upper end portion of the pump chamber 24 through the joint 41. The joint 43 supports the discharge valve 42 and is attached to the joint 41. The nut 44 is coupled to the upper end portion of the joint 43 and is employed for connecting a pipe.

Figure 3:
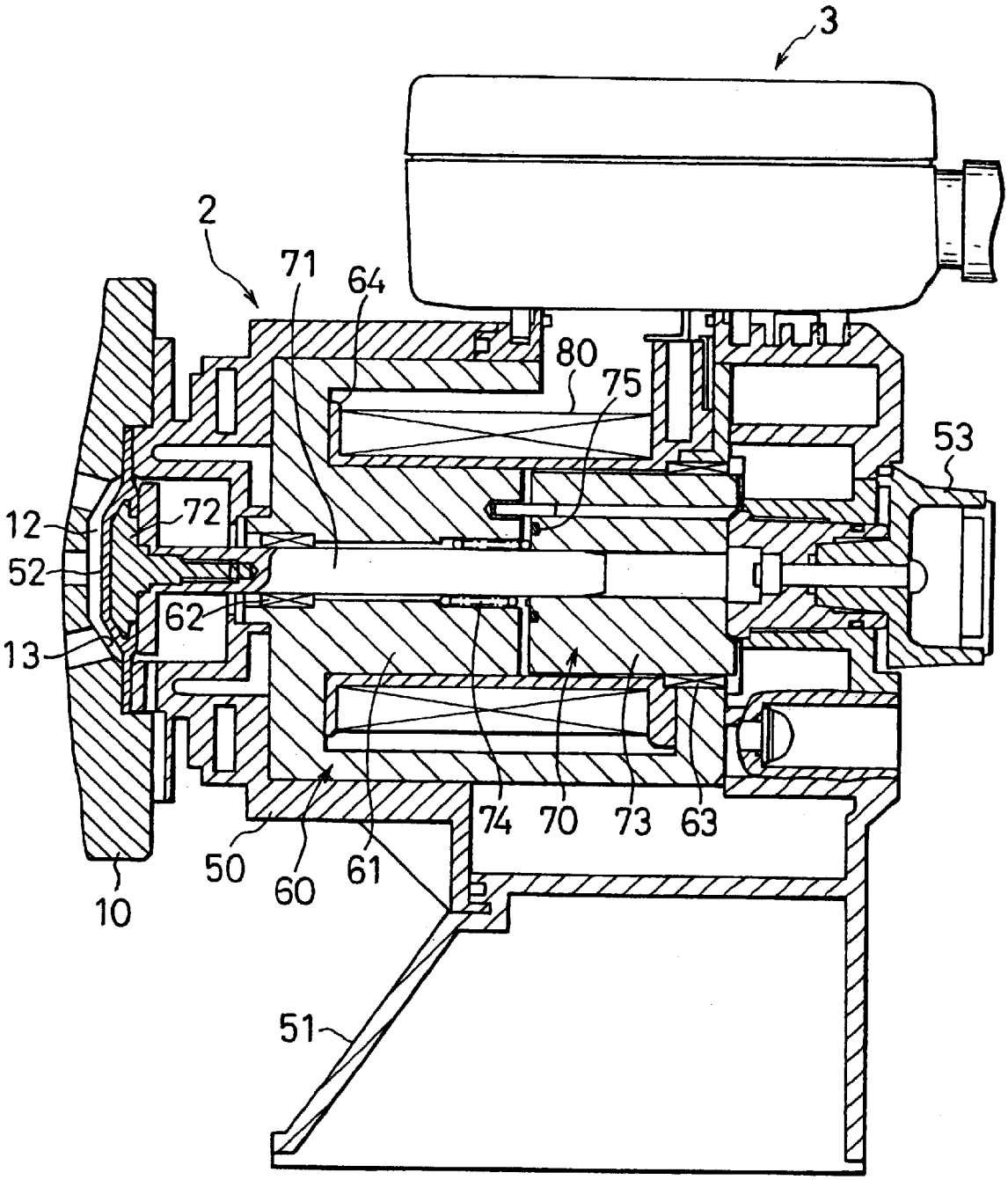
FIG. 3 is a cross sectional view of an electromagnetic driver of the pump.

As the cross section is shown in FIG. 3, the electromagnetic driver 2 comprises a frame 50 having a pedestal 51, a stationary section 60 fixed on the frame 50, a movable section 70 capable of moving relative to the stationary section 60, and an electromagnetic coil 80 for driving the movable section 70 with an electromagnetic force. A diaphragm 52 is mounted on the front surface of the frame 50. The front surface of the frame 50 is coupled to the side of the pump head body 10 in such a state that the diaphragm 52 is accommodated within the recess 13 of the pump head body 10 so as to form the actuator fluid chamber 12.

The diaphragm 52 is coupled through a diaphragm support 72 to the top end portion of a rod-like plunger 71 that is composed of the movable section 70. The plunger 71 is supported via a thrust bearing 62 in the central bore of a stationary core 61 that is composed of the stationary section 60 so that it is freely movable in the axial direction. A plunger core 73 is fixed on the rear end portion of the plunger 71. The plunger core 73 is supported via a thrust bearing 63 so that it is freely movable in the axial direction. The front surface of the plunger core 73 opposes to the rear surface of the stationary core 61 via a certain gap therebetween. An inner circumferential groove is formed in the stationary core 61 at the center close to the rear surface thereof. A return spring 74 is accommodated between the inner circumferential groove and the front surface of the plunger core 73 to drive the plunger 71 normally backward via the plunger core 73. An O-ring 75 is mounted on the front surface of the plunger core 73 to absorb shocks. These plunger 71, diaphragm support 72, plunger core 73, return spring 74 and O-ring 75 compose of the movable section 70.

The stationary section 60 comprises the stationary core 61 for supporting the plunger 71, and a coil holder 64 provided to extend over the stationary core 61 and the plunger core 73 for surrounding them. The electromagnetic coil 80 is mounted on the coil holder 64. A button 53 for adjusting a stroke is provided on the rear end portion of the frame 50 to regulate a position of the rear end of the plunger core 73 by adjusting a position of the front end of the button 53 back and forth.

Operations of thus configured tube pump will be described next.

The plunger 71 is always driven backward by a resilient force of the return spring 74. When the electromagnetic coil 80 is energized in this state, the stationary core 61 attracts the plunger core 73 to protrude the plunger 71 forward. The control unit 3 can control a frequency for energizing the electromagnetic coil 80 to control a frequency for moving the plunger 71 back and forth.

As the plunger 71 moves back and forth, the diaphragm 52 moves back and forth. Therefore, the actuator fluid in the actuator fluid chamber 12 is extruded to the periphery of the tube 22 through the actuator fluid paths 14*a*–14*c* and the connection holes 211*a*–211*c* of the cylinder 21. To the contrary, the actuator fluid on the periphery of the tube 22 is absorbed into the actuator fluid chamber 12 through the connection holes 211*a*–211*c* of the cylinder 21 and the actuator fluid paths 14*a*–14*c*. As a result, the pump chamber 24 inside the tube 22 expands and contracts at the drive frequency of the electromagnetic driver 2. In response to this operation, the object fluid is introduced from the intake unit 30 into the pump chamber 24 and the object fluid inside the pump chamber 24 is discharged to the external through the discharge unit 40.

According to this tube pump, when the stationary core 61 attracts the plunger core 73 by means of the electromagnetic attraction force of the electromagnet in the electromagnetic driver 2, the plunger 71 is directly driven, and thus the diaphragm 52 at the top end of the plunger 71 is also driven in connection with this motion. By such the operation, a short stroke attraction can be achieved in a short time period employing the electromagnetic attraction force of the electromagnet. Therefore, an acceleration for actuating the plunger 71 can be increased and an inertial force applied to the object fluid can also be increased. Accordingly, the flow speed of the object fluid within the pump chamber can be greatly increased compared to the conventional motor-driven reciprocal pump. On the other hand, since the transportation path for the object fluid elongates straight in the vertical direction, there is no part to resist the slurry solution to be conveyed. In addition, the effect of preventing the slurry solution from staying is larger than that of the conventional diaphragm pump when increasing an instantaneous flow speed of the slurry solution. Thus, it is possible to realize a pump that hardly stays the slurry.

In addition, according to this tube pump, the cylinder unit 20 can be easily removed from the pump head body 10. This can be performed by unscrewing and removing the discharge valve unit 40 from the pump head body 10, then screwing male screws into female threaded portions formed in the central bores 231*a* and 231*b* of the upper and lower tube retainers 23*a* and 23*b* (or only the upper tube retainer 23*a*) of the cylinder unit 20, and pulling them upward as shown in FIG. 4. This allows the user to perform maintenance when cleaning the pump chamber and replacing the expired flexible tube without disassembling the whole liquid contact sections in the pump.

By the way, when conveying a small constant amount of a foaming chemical solution such as sodium hypochlorite and hydrazine that would easily generate a gas from the chemical solution, it is necessary to increase a compressibility to prevent the gas lock. In general, the compressibility is represented by the following equation:

$$C=VT/(VT-VE)=1/(1-VE/VT)$$

where C: Compressibility;

VT: Total volume of the pump chamber; and

VE: Ejected volume per stroke.

Assuming that the ejected capacity (i.e. discharged amount) per stroke is not varied, by determining the total capacity of the pump chamber smaller, that is, a dead volume in the pump chamber as small as possible, the compressibility can be increased. For this reason, the reciprocal pump of plunger type has been employed in the art, which can miniaturize the pump chamber. This pump is expensive, however, and has a disadvantage that the leakage to external occurs through the sealing of the plunger.

Figure 5:
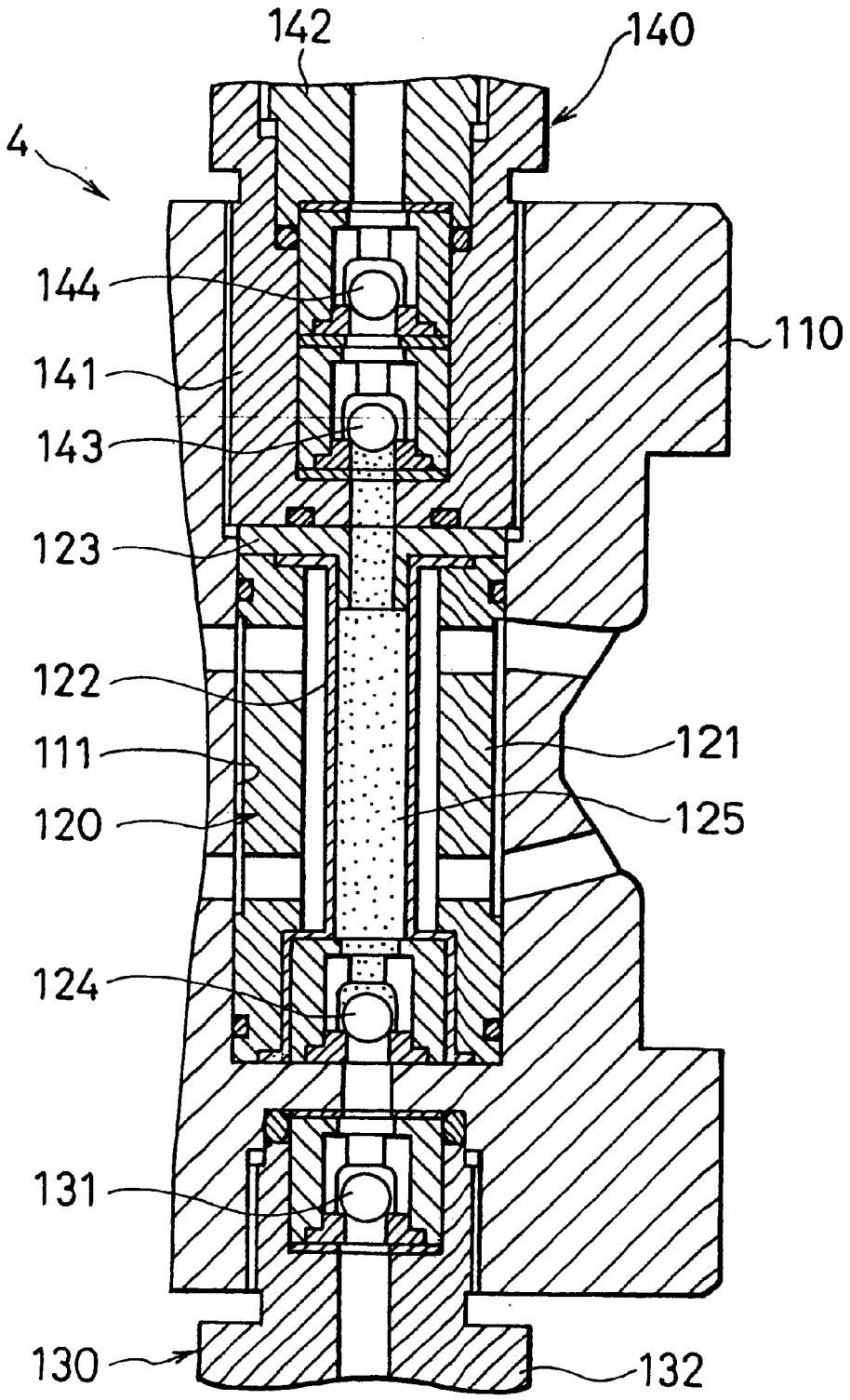
FIG. 5 is a cross sectional view of a tube pump head in a tube pump according to a second embodiment of the present invention.

FIG. 5 is a cross sectional view showing a pump head 4 of a tube pump according to a second embodiment capable of increasing the compressibility in consideration of such the problem.

An intake valve 124 is provided in an absorbing opening, in the form of interposing into an inner space of a flexible tube 122 disposed within a cylinder 121 of a cylinder unit 120 accommodated inside a cylindrical space 111 at the center of a pump head body 110. The intake valve 124 serves as a tube retainer at the lower end of the tube 122. Another tube retainer 123 at the upper end of the tube 122 is similar to that in the preceding embodiment. In an intake valve unit 130, another intake valve 131 is supported by a joint 132 and is arranged in serial to the intake valve 124. In a discharge unit 140, discharge valves 143 and 144 are arranged serially between joints 141 and 142.

This embodiment intends to reduce a volume of a pump chamber 125 by allowing the flexible tube 122 to contain the intake valve 124 inside the intake opening. A dot-hatched part shows the pump chamber 125 in the figure. The intake valve 124 hardly effects the deformation of the tube 122 because it is inserted into the lower end portion of the tube 122. Although the intake valve 124 is accommodated only in the absorbing side in this embodiment, the discharge valve 143 may also be accommodated in the discharging side of the tube 122. Alternately, the intake valve 124 and discharge valve 143 may be accommodated inside the tube 122 in the proximity of both ends.

Figure 6:
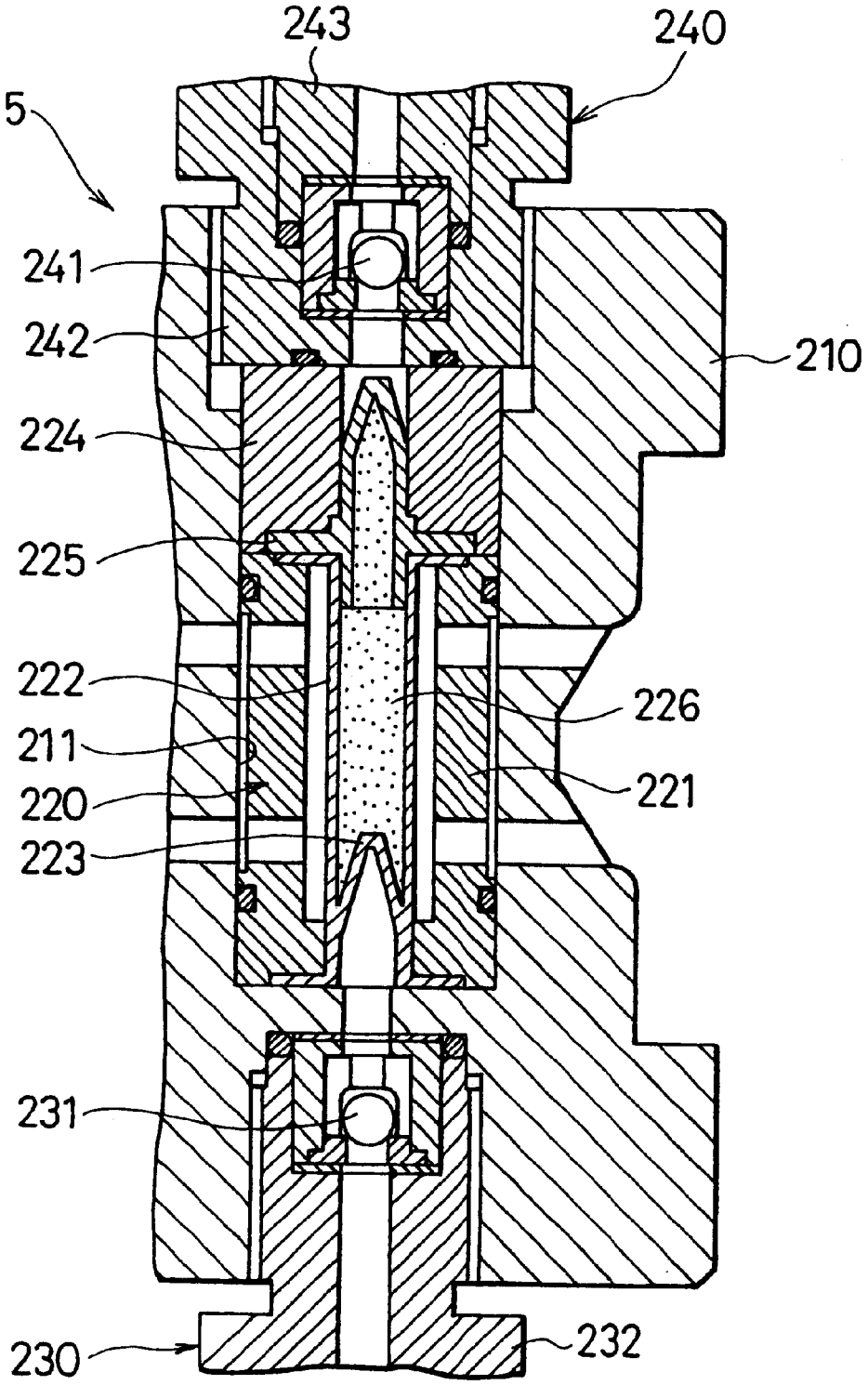
FIG. 6 is a cross sectional view of a tube pump head in a tube pump according to a third embodiment of the present invention.

FIG. 6 is a cross sectional view showing a pump head 5 of a tube pump according to a third embodiment.

This embodiment alters the intake valve 124 and discharge valve 143 in the second embodiment into those of duckbill valve type. Formed at the absorbing side inside a flexible tube 222 disposed within a cylinder 221 of a cylinder unit 220 accommodated inside a cylindrical space 211 at the center of a pump head body 210 is an intake valve 223 of duckbill valve type, which is integrally formed with the tube 222. A discharge valve 225 of duckbill valve type is mounted between a tube retainer 224 at the upper end of the tube 222 and the tube 222. An intake valve unit 230 includes an intake valve 231, and a joint 232 for securing the intake valve to the pump head body 210. A discharge valve unit 240 includes a discharge valve 241, a joint 242 for securing the discharge valve to the pump head body 210, and another joint 243 for securing the joint 242 to the discharge valve 241.

This embodiment can reduce a volume of a pump chamber 226 as similar to the preceding embodiments, and can simplify a structure by integrally forming the intake valve 224 with the flexible tube 222.

According to the present invention, the plunger is connected to the diaphragm that faces on the actuator fluid space outside the flexible tube, and the plunger is reciprocally driven by the electromagnet. Accordingly, a drive speed can be greatly increased compared to the oil hydraulic method using the crankshaft and piston. As a result, it is possible to increase a flow speed of the object fluid that passes through the tube-phragm, and to effectively prevent the slurry from staying.

Having described the embodiments consistent with the present invention, other embodiments and variations consistent with the present invention will be apparent to those skilled in the art. Therefore, the invention should not be viewed as limited to the disclosed embodiments but rather should be viewed as limited only by the spirit and scope of the appended claims.

What is claimed is:

1. A tube pump, comprising a pump head and a pump driver for driving said pump head, wherein said pump head including:

a cylinder having a cylindrical space formed therein;

a cylindrical flexible tube arranged coaxially within said cylindrical space of said cylinder, an outer space between said cylindrical flexible tube and said cylinder defining an actuator fluid space to be filled with an actuator fluid, an inner space within said cylindrical flexible tube defining a pump chamber for conveying an object fluid;

an intake valve attached to one end portion of said cylindrical flexible tube; and a discharge valve attached to the other end portion of said cylindrical flexible tube, and wherein said pump driver is an electromagnetic driver including:

a plunger arranged reciprocally movable in the axial direction;

and electromagnet for periodically attracting said plunger to drive said plunger in said axial direction reciprocally; and a diaphragm mounted on the top portion of said plunger and facing said actuator fluid space for absorbing and discharging said actuator fluid into and from said actuator fluid space in response to said plunger reciprocally moving.

2. The tube pump according to claim 1, wherein said cylinder and said cylindrical flexible tube are coupled with each other to construct a cylinder unit, said cylinder unit being removably mounted onto a pump head body having a cylindrical space in a liquid-tight state.

3. The tube pump according to claim 2, wherein the outer surface of said pump head body has a recess formed therein for composing an actuator fluid chamber in cooperation with the top surface of said diaphragm of said electromagnetic driver, facing said recess.

4. The tube pump according to claim 1, wherein at least one of said intake and discharge valves are arranged within the inner space in the proximity of both end portions of said cylindrical flexible tube.

5. The tube pump according to claim 1, wherein said intake and discharge valves are duckbill-type valves integrally formed with said flexible tube, at least one of said valves being arranged within the inner space in the proximity of both end portions of said cylindrical flexible tube.

6. A tube pump for conveying a slurry solution, comprising:

a pump head body having a first cylindrical space formed therein and an actuator fluid path formed through a sidewall thereof;

a cylinder arranged within said first cylindrical space of said pump head body, said cylinder having a second cylindrical space formed therein and a connection hole formed in a sidewall to connect said second cylindrical space with said actuator fluid path;

a flexible tube arranged coaxially within said second cylindrical space of said cylinder, an outer space between said flexible tube and said cylinder defining an actuator fluid space to be filled with an actuator fluid, an inner space within said flexible tube defining a pump chamber for conveying a slurry solution;

an intake valve attached to one end portion of said flexible tube;

a discharge valve attached to the other end portion of said flexible tube, and an electromagnetic driver connected to said pump head body, said electromagnetic driver including: a plunger arranged reciprocally movable in a direction perpendicular to said cylinder; an electromagnet for periodically attracting said plunger to drive said plunger reciprocally; and a diaphragm mounted on the top portion of said plunger and facing said actuator fluid space for absorbing and discharging said actuator fluid into and from said actuator fluid space in response to said plunger reciprocally moving.

7. The tube pump according to claim 6, wherein said cylinder and said flexible tube are coupled with each other to construct a cylinder unit, said cylinder unit being removably mounted onto said pump head body in a liquid-tight state.

* * * * *